US005660224A

United States Patent [19]

Barbe et al.

[11] Patent Number: 5,660,224

[45] Date of Patent: Aug. 26, 1997

[54] TWIN-ROLL CONTINUOUS CASTING DEVICE HAVING AN INERTING SHROUD

[75] Inventors: Jacques Barbe, Saint-Etienne; Pierre Delassus, Locon; Jean-Marie Pelletier, Bethune; Gerhard Pateisky, Verquin, all of France

[73] Assignees: Usinor-Sacilor, Puteaux, France; Thyssen Stahl Aktiengesellschaft, Duisburg, Germany

[21] Appl. No.: 564,962

[22] Filed: Nov. 30, 1995

[30] Foreign Application Priority Data

Nov. 30, 1994 [FR] France ..... 94 14571

[51] Int. Cl.[6] ..... B22D 11/00; B22D 11/06

[52] U.S. Cl. ..... 164/415; 164/428

[58] Field of Search ..... 164/428, 415, 164/480, 475

[56] References Cited

U.S. PATENT DOCUMENTS 5,590,701 1/1997 Fukase ..... 164/428

FOREIGN PATENT DOCUMENTS 9322087 11/1993 Australia .
9402269 2/1994 Australia .
409645 1/1991 European Pat. Off. .

*Primary Examiner*—Joseph J. Hail, III
*Assistant Examiner*—I.-H. Lin
*Attorney, Agent, or Firm*—Nilles & Nilles, S.C.

[57] ABSTRACT

The twin-roll continuous casting device comprises two counterrotating rolls (1, 2), having parallel axes, defining between them a casting space (5), and a shroud (4) placed above the casting space and including two longitudinal walls (41) which extend respectively along the surface of each roll. Each wall (41) includes two gas inlet pipes (45, 46) which include openings emerging towards the said surfaces, these pipes being mutually parallel and adjacent to the surface of the roll, and are separated by pressure-drop seals (50, 64) so that the flow of gas supplied by the pipe (45) lying upstream, in relation to the direction of rotation of the roll, is exclusively directed towards the outside of the shroud, the flow supplied by the pipe (46), located further downstream, being directed towards the casting space. Application especially to the twin-roll continuous casting of thin steel strip.

10 Claims, 4 Drawing Sheets

TWIN-ROLL CONTINUOUS CASTING DEVICE HAVING AN INERTING SHROUD

BACKGROUND OF THE INVENTION

1. Field of the Invention

The present invention relates to a twin-roll continuous casting device which includes a shroud for inerting the casting space defined between the said rolls.

2. Description of the Prior Art

Twin-roll continuous casting plants are already known, especially for direct production of thin steel strip, which include two counterrotating rolls, having parallel axes, defining between them a casting space into which is poured molten metal which solidifies on contact with the cooled walls of the rolls and is extracted in the form of strip while the said rolls are rotating.

A known problem is that the metal contained in the casting space tends to cool at the surface and thus to create parasitic solidifications which impair correct operation of the plant. In order to remedy this problem, it has already been proposed to place a thermally insulating hood above the casting space.

Moreover, in order to prevent the molten metal from oxidizing and from starting to solidify, it has also been proposed to use a shroud system into which an inerting gas is injected in order to prevent ambient air from coming into contact with the liquid metal and the skin of metal which is solidifying. In order to prevent an excessive consumption of this inerting gas, the hood is placed as close as possible to the surface of the rolls, without touching them however, as well as to the upper part of the side walls. Since the rolls are rotating and, in addition, may deform by expansion, it is not possible to ensure good sealing between the said hood and the rolls using static seals. In addition, such seals would run the risk of damaging the surface of the rolls. Thus, it has already been proposed to ensure sealing by blowing an inert gas into the zone where the rolls are covered by the hood, in order both to prevent air from getting in under the hood and to prevent the inerting gas from leaking away outside the protected volume of the mould.

Thus, document EP-A-0,409,645 describes a plant in which channels for injecting an inert gas are arranged against the longitudinal side walls of a hood which covers the casting space, these channels including a slot facing the surface of the rolls so as to blow the said inert gas towards this surface, in order to remove therefrom the film of air entrained by the rolls while they are rotating, and particularly the air contained in the hollows forming the rugosity of the said surface, this being done so as to prevent the said air from penetrating the casting space and therefore to maintain a non-oxidizing atmosphere therein.

In order to distribute the inert gas over the entire width of the rolls, provision is made for the said channels to be able to be partitioned. The document mentioned hereinabove also describes an alternative embodiment in which an external cover is fixed to the lower edge of the side wall of the hood, and positioned adjacent to the surface of the rolls, and includes at its outer edge a channel for influx of inert gas, this being arranged so as to prevent, even more effectively, air from entering the casting space because of the fact that the inside of the said cover is filled with inert gas.

However, these systems are not completely satisfactory since, although they seem a priori capable of preventing air from entering the casting space, they do not enable the gas supplied into this space to be effectively controlled because of the fact that the inert gas blown in via the slots in the channels can be distributed both upstream and downstream of these slots. Since the amount of this gas discharged upstream, that is to say towards the outside, can vary depending especially on the space between the said channels and the surface of the corresponding roll, and on the tangential speed of the latter or on the amount of air drawn in by the rotation of the rolls, it follows that the flow of the remaining gas directed downstream, that is to say towards the casting space, is also variable. Such variations are deleterious, both for the manufacturing process and for the cast product, since an excess of gas may lead to the formation of parasitic solidifications, due to the cooling effect which it exerts on the cast metal, or to the said metal being saturated with gas, or else to a variation in the profile of the roll.

OBJECT AND SUMMARY OF THE INVENTION

The objectives of the present invention are especially to solve these problems, and its purpose is particularly to propose a shroud system making it possible to ensure reliable inerting of the casting space, effective control of the nature and amount of gas drawn in by the surface rugosities on the rolls, because said gas, remaining trapped in the rugosity hollows between the rolls and the skin of solidified metal, influences the heat flux between the said metal and the walls of the rolls and therefore influences the solidification conditions and the shape of the said walls.

With these objectives in mind, the subject of the invention is a twin-roll continuous casting device, comprising two counterrotating rolls, having parallel axes, defining between them a casting space, and a shroud placed above the casting space and including two longitudinal walls which extend respectively along the surface of each roll and which are provided with gas inlet pipes having openings emerging towards the said surfaces, characterized in that each wall includes pressure-drop sealing means for creating a pressure drop in a zone located between the said wall and the surface of the corresponding roll and between two of the said pipes, so that the flow of gas supplied by the pipe lying downstream, in relation to the direction of rotation of the roll, is directed towards the outside of the shroud and the flow of gas supplied by the pipe located upstream is directed towards the casting space.

Thus, it becomes possible to control the inerting and the conditions of heat exchange between the cast metal and the rolls effectively because of the fact that the device according to the invention makes it possible in practice to dissociate the two functions of the gases drawn in between the shroud and the rolls, that is to say:

- on the one hand, the sealing of the casting space with respect to the ambient atmosphere, this sealing being provided by the gases supplied by the pipe lying further upstream,
- and, on the other hand, the inerting and the management of the interface between the cast metal and the rolls, from a thermal (heat flux from the metal to the rolls) and chemical (influence of the nature of the gas on the cast metal, in particular oxidation) standpoint, this being provided by the gases supplied by the other pipe, located further downstream.

According to particular arrangements of the invention, the said pressure-drop sealing means are formed by a projection of the wall extending between the said pipes into the immediate vicinity of the surface of the roll, and they may include longitudinal grooves, parallel to the said pipes; these grooves, being located in the immediate vicinity of each rolls surface, constitute with the latter a series of baffles accentuating the pressure drop between the pipes.

In order to improve the distribution of the gases supplied by the pipes over the entire width of the rolls, these are drilled in the said walls and the said openings preferably consist of a continuous slot along the length of the said pipes, or of several adjacent slots, and the pipes contain, at least in the zone of the said openings emerging opposite the surface of the roll, a porous material.

Also preferably, the device includes means for controlling the position of the shroud in relation to the surface of the roll. These means, comprising for example position sensors connected to the shroud and measuring the variations in the distance of the surface of the rolls in relation to the said shroud, and cylinder actuators for adjusting the position of the shroud in relation to the chassis of the device make it possible to keep the pipes and above all the pressure-drop sealing means at a substantially constant distance from the surface of the rolls, when this surface deforms by thermal expansion, so that the pressure drop between the pipes remains substantially constant and as high as possible.

According to yet other arrangements:

- the shroud includes, on the inside, a heat shield made of refractory material joining the two walls while at the same time allowing passage of a feed nozzle and separating the casting space from an upper chamber of the shroud, and openings are made in the said shield in order to bring the casting space into communication with the said upper chamber;
- the device includes adjustment means for independently adjusting the pressure and/or the nature of the gas supplied in each channel;
- the device includes dynamic sealing means for sealing between the shroud and walls for the lateral containment of the casting space;
- the device includes dynamic sealing means for sealing between the shroud and the ends of the rolls.

Other characteristics and advantages will appear in the description which will be given of a plant for the twin-roll continuous casting of thin steel strips.

BRIEF DESCRIPTION OF THE DRAWINGS

Reference will be made to the appended drawings in which.

DESCRIPTION OF THE PREFERRED EMBODIMENT

Figure 2:
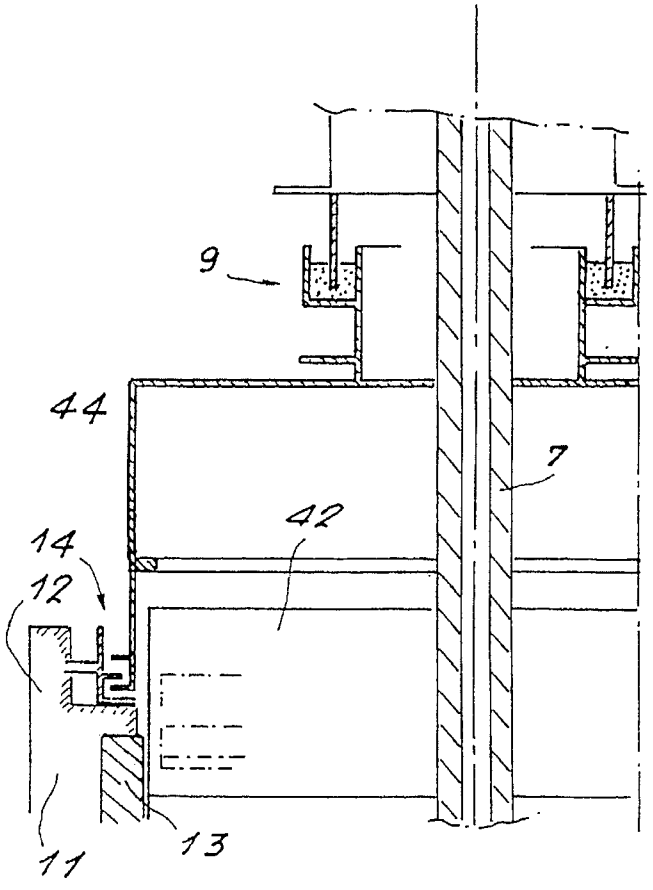
FIG. 2 is a partial sectional view along the line II—II in FIG. 1.
Figure 1:
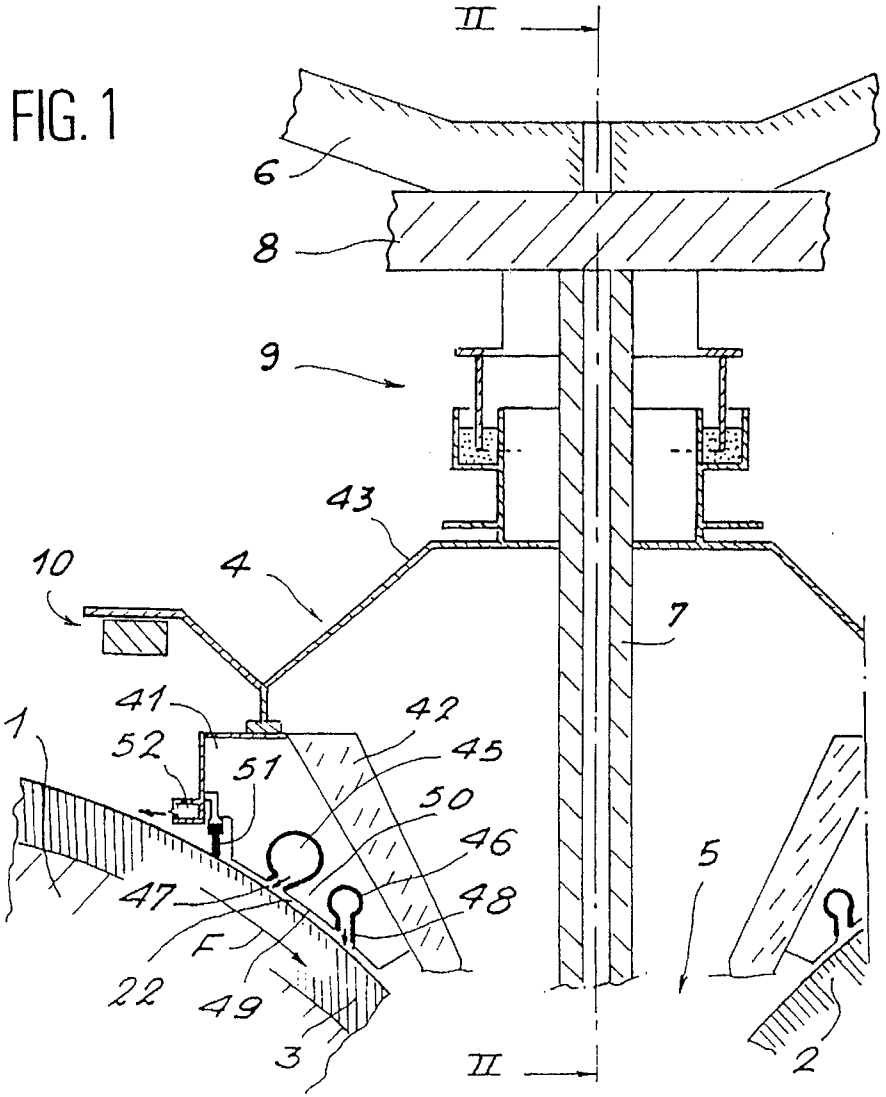
FIG. 1 is a partial diagrammatic view of a device according to the invention, in cross-section.

The drawing of FIGS. 1 and 2 shows diagrammatically, in section in a plane perpendicular to the axes of the rolls, the molten-metal feed zone of a continuous casting plant. This plant comprises two casting rolls 1, 2, the external wall 3 of which, conventionally consisting of a shell or sleeve, is vigorously cooled. The rolls 1 and 2 are rotationally driven along the arrow F. An inerting and thermal insulation shroud 4 is located above the casting space 5 defined between the two rolls. The shroud is joined to a tundish 6 containing the molten metal, to which is fixed a feed nozzle 7 which extends vertically right down to the casting space 5. Closure means 8, such as, for example, a slide valve system of type known per se, are placed on the tundish, in order to be able to close off the nozzle 7. The shroud 4 is joined in a sealed manner to this slide valve system by sealing means 9, surrounding the nozzle, for example, as shown in FIGS. 1 and 2, a sand seal system; these sealing means allow a possible slight shift between the tundish and the casting plant, while still maintaining the required sealing, and thereby simultaneously allow inerting of the nozzle.

The shroud 4 is held in place on the plant by support means 10 which can be adjusted, in particular vertically, so that longitudinal walls 41 of the shroud are held in place above the shells 3 of the rolls, at a short distance from their surfaces. The longitudinal walls 41 therefore extend parallel to the axes of the rolls 1, 2, over the entire width of the shells, and bear on each of their faces directed towards the inside of the shroud, a thermal protection lining consisting, for example, of refractory elements 42 which extend downwards below the said longitudinal walls 41 into the vicinity of the surfaces of the rolls so as to protect the said walls from the thermal radiation from the molten metal contained in the casting space.

A sealed hood 43 provides the connection between the longitudinal walls 41 and the sealing means 9. In order to seal the casting space near the ends of the rolls, the hood 43 includes front walls 44 which extend vertically down to the lateral containment walls 11, placed conventionally against the ends of the rolls in order to contain the casting space near the said ends of the rolls. It will be recalled that these containment walls, known elsewhere, generally include a metal casing 12, only the upper part of which is shown in FIG. 2, which supports a refractory lining 13 applied against the frontal ends of the shells 3. Dynamic sealing means 14 are provided between the lower ends of the front walls 44 of the shroud and the said lateral containment walls 11, these dynamic sealing means preferably consisting of a baffle-type sealing system which makes it possible to provide pressure-drop sealing without direct contact between the casing 12 and the shroud 4. Thus, satisfactory sealing may be achieved despite the movements of the lateral containment walls 11, these movements being inevitable during casting.

Sealing means of a similar type, not shown, are moreover provided between the end edges of the longitudinal walls 41 and the said lateral containment walls 11.

Each longitudinal wall 41 of the shroud includes two mutually parallel pipes 45, 46 extending in the immediate vicinity of the wall of the rolls and over their entire width. Each of these pipes emerges laterally, via respective openings 47, 48 made in the form of longitudinal slots, on the lower surface 49 of the wall 41, facing the surface of the roll. Provided between the two pipes, and therefore between their respective slots, in the zone 22 delimited by the lower surface of the wall and the surface of the roll, are pressure-drop sealing means formed, for example, simply by a part 50 of the wall, projecting towards the roll in relation to the said pipes. This projecting part is shaped so as to create a large pressure drop for gases conveyed between the wall and the surface of the roll. In the example shown in FIG. 1, the slots 47, 48 emerge in an inclined direction in relation to the surface of the rolls, the inclination of the slots 47 in the pipe 45 located further upstream in relation to the direction of rotation of the roll 1 being directed towards the outside of the shroud, so that a flow of gas leaving these slots is virtually exclusively directed towards the outside, whereas the slots 48 in the pipe 46, located downstream, are preferably directed towards the casting space. Thus, when a pressurized inert gas is injected into the pipe 45, it is directed via the slots 47 towards the surface of the roll 1 and in the opposite direction to the rotation of the latter, in order to prevent the outside air from penetrating the casting space. Additionally, a brush 51, or an equivalent system, is located against the external face of the wall 41 in order to limit the amount of air conveyed under the longitudinal wall because of the rotation of the rolls, and in particular to protect the said wall from rising hot-air currents generated by the rotation. Blowing means 52 are arranged further upstream of the brush 51 in order to direct a stream of gas towards the surface of the roll 1, also in the opposite direction to the rotation of the latter.

From the foregoing, it will already be understood that the pipe 45 and the slots 47 make it possible to supply, at the interface between the longitudinal wall 41 of the shroud 4 and the roll, a flow of gas directed towards the outside of the shroud, and which, in combination with the blowing means 52 and the brush 51, prevents air entrained with the rotating roll from going towards the casting space, whereas the pipe 46 makes it possible to supply, directly against the surface of the roll, an inerting gas or a gas mixture having predetermined characteristics, which may be adapted according to the casting conditions, and the short distance between the projecting part 50 and the surface of the roll creating a sufficient pressure drop in the zone 22 between the two pipes in order to provide the best possible sealing between them. It will therefore be endeavoured to minimize as far as possible the distance between the surface of the roll and the projecting part 50, especially by making this part 50 so that its surface is closer to the roll than that of the parts of the wall which are located on either side of the pipes.

Figure 3:
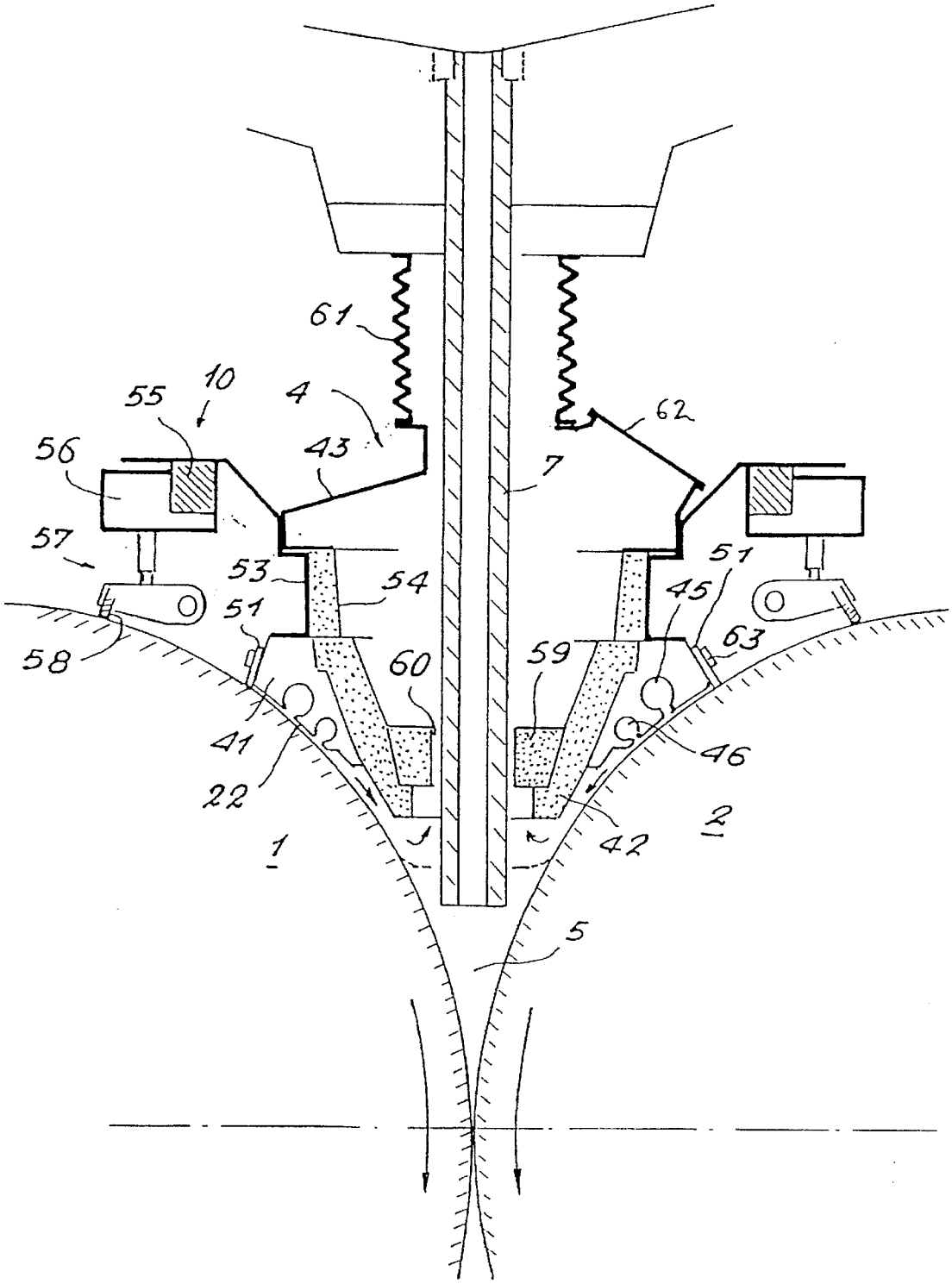
FIG. 3 is a cross-sectional view of the continuous casting plant.
Figure 4:
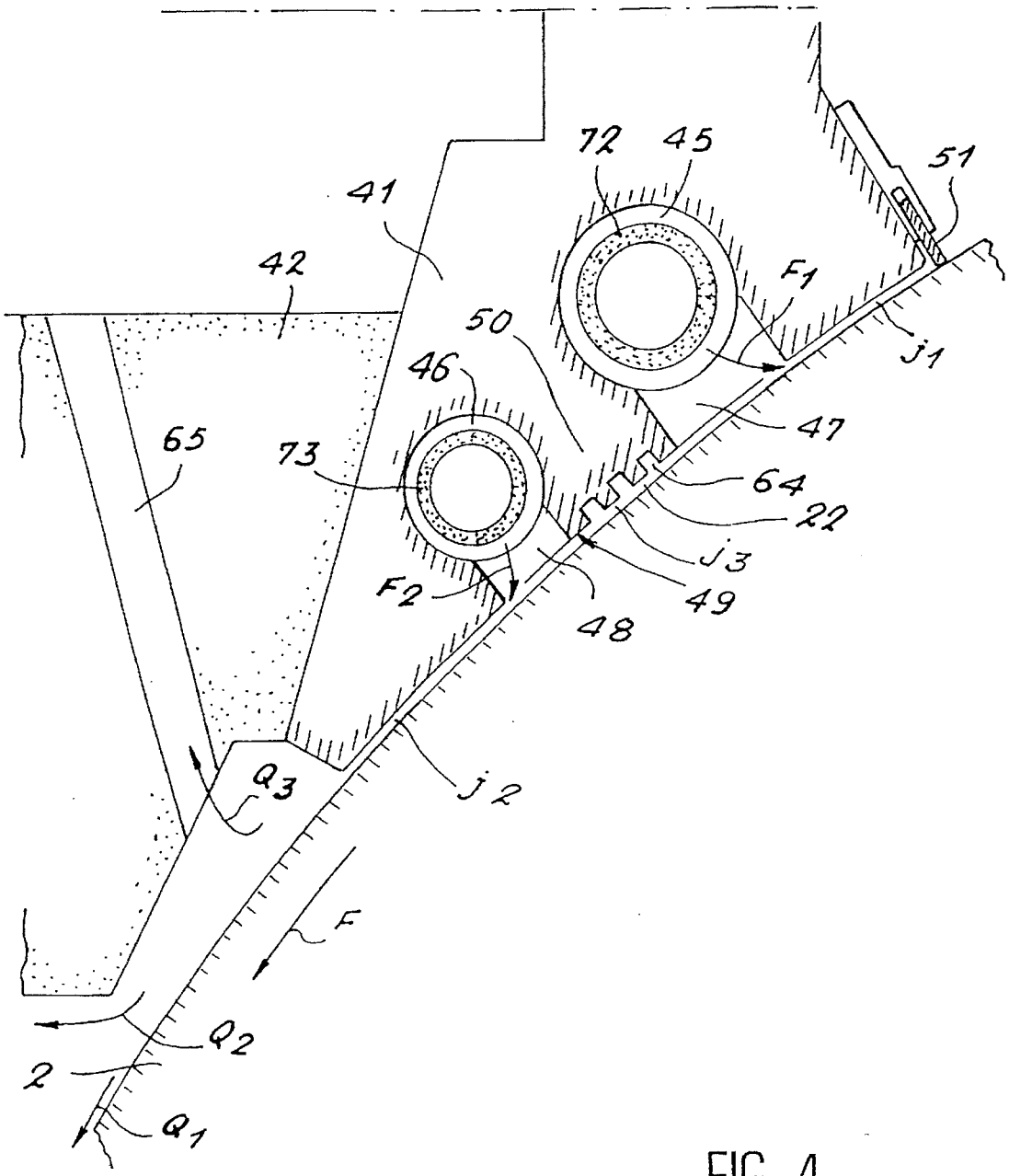
FIG. 4 is a detailed view of the contact zone between the shroud and one roll.

The drawings of FIGS. 3 and 4 show an alternative embodiment of the continuous casting device. Only those elements of this device which differentiate it from the previously described device will be described. In this alternative form, the longitudinal walls 41 are surmounted by a frame 53 to which they are connected, this frame also being internally lined with a thermal protection refractory 54. The means 10 for supporting the shroud are fixed to this frame and rest via cylinder actuators 55 on transverse members 56 of the framework of the plant. The transverse members 56 also carry windbreak systems 57 comprising a lip 58 arranged as close as possible to the surface of the rolls, but without contacting them, the purpose of these windbreaks being to protect the longitudinal walls 41 from the hot-air currents which envelop the rolls during casting. Placed between the refractory elements 42 is a heat shield 59 consisting of a plate of refractory material extending substantially horizontally and joining the said elements 42, an opening 60 being provided in this plate in order for the nozzle 7 to pass through.

The frame 53 is surmounted by the hood 43, which is joined to the slide valve 8 of the tundish via a sealing means having a degree of flexibility and having an adjustable height, such as the bellows 61. In addition, the hood may include various accessories, such as the observation window 62, or supports for apparatuses for measuring the level of metal in the casting space, etc.

Non-contacting distance measurement sensors 63, of known type, for example capacitive sensors, are placed on the longitudinal walls 41, in the vicinity of the rolls, in order continuously to measure the distance of the said walls 41 with respect to the surface of the rolls and to control the cylinder actuators 55 in order to keep this distance constant. These sensors could be replaced by any other means making it possible to control the position of the shroud in relation to the position of the surface of the rolls in the zone adjacent to the pipes 45, 46.

The pipes 45 and 46 preferably contain a porous material making it possible for the distribution of the gas supplied in these pipes to be uniform over their entire length. In the example shown in FIG. 4, tubes 72, 73 of such a porous material are placed, for this purpose, respectively in the pipes 45, 46, the gas being supplied inside these tubes and being distributed uniformly along the length of the pipes as it passes through the said porous material.

The principle of the sealing between the longitudinal wall 41 and the roll will be better understood in the light of FIG. 4 which shows this wall in section on an enlarged scale.

The gas fed into the pipe 45, located further upstream in relation to the direction of rotation of the roll, escapes from this pipe via the openings 47, creating a laminar gas flow (arrows F1) in the opposite direction to the rotation of the roll (arrow F), which forms a barrier for the film of air entrained by the rotation of the roll 2.

The gas fed into the pipe 46, located further downstream, escapes from this pipe via the openings 48, creating another laminar flow (arrows F2) in the same direction as the rotation of the roll. This results, in particular, in a great dilution of the oxygen contained in the air boundary layer adhering to the rolls, which could get round the barrier formed by the gas flow coming from the pipe 45.

The two gas flows (F1, F2) are, at the interface between the wall 41 and the surface of the roll, separated by a virtually stationary gaseous partition retained in the zone 22 by the baffles which are formed by the grooves 64 made in the lower surface of the wall 41, between the two pipes 45, 46, and parallel to them. It will be easily understood that this gaseous partition, which generates a pressure drop between the outlets of the pipes at the lower surface 49 of the wall 41, can produce its effect only if the distance between this surface 49 and the wall of the roll is sufficiently short, which makes it necessary to be able to maintain this short distance during casting, despite the deformations due to the expansion of the roll, by acting on the cylinder actuators 55 for vertically positioning the shroud. By way of example, the distance J1 between the roll and the lower surface 49 of the wall 41, upstream of the pipe 45, is preferably less than or equal to 2 mm, the corresponding distance j2, downstream of the pipe 46, is less than or equal to 2.5 mm, and the distance j3, in the region of the zone 22, is less than or equal to 1.5 mm.

In addition to the oxygen dilution effect already mentioned, the inerting gas flow coming from the pipe 46 has two other main effects which will be explained hereinbelow.

In practice, the flow of gas which penetrates the casting space is distributed as a flow Q1, which remains within the boundary layer attached to the roll, penetrates between the surface of the roll and the cast metal and therefore is involved in the heat exchange between this roll and this cast metal, and a flow Q2 which passes over the surface of the bath of cast metal and provides the inerting thereof. A third flow Q3 escapes towards the upper part of the shroud, through openings 65 made for this purpose in the refractory lining 42 and/or the heat shield 59, in order to prevent too great a flow reaching the meniscus of the cast metal, which could lead to the said metal being saturated with gas and cooling it.

Figure 5:
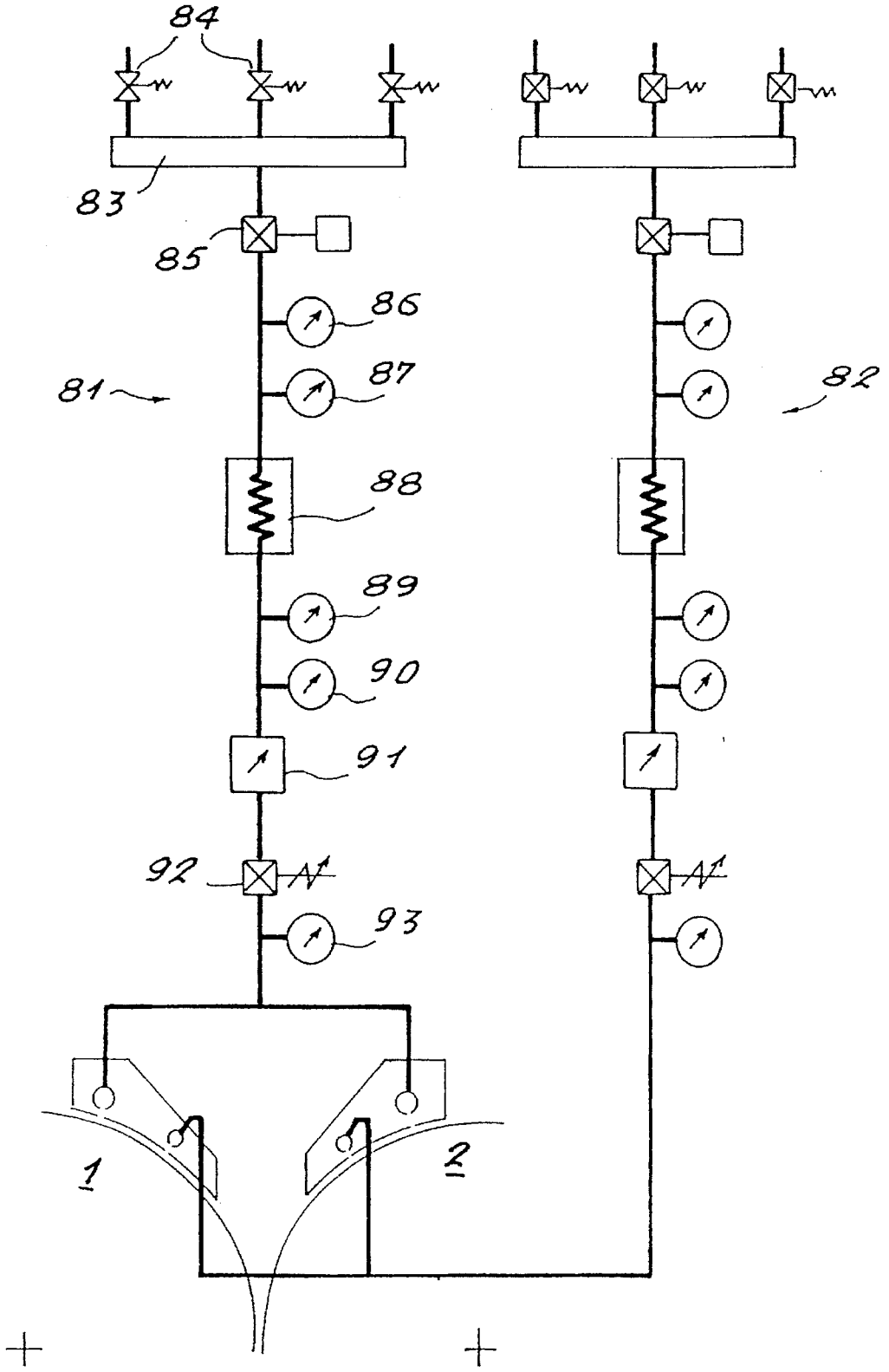
FIG. 5 is a representation of the gas-feed circuits for the pipes provided in the walls of the shroud.

In order for the gases, or gas mixtures, fed respectively into the pipes 45, 46, to be able to provide the various effects described hereinabove, it is necessary to be able to control their feed, both in terms of flow rate and pressure and, in the case of gas mixtures, in terms of their nature. For this purpose, the device includes adjustment and control means placed in independent circuits for feeding the pipes 45, 46, these being shown in the drawing in FIG. 5.

A first feed circuit 81 is connected to the pipes 45 in the two walls 41, and a second similar circuit 82 feeds simultaneously the pipes 46.

Each circuit comprises a mixing chamber 83 connected to the feed systems for the various inerting gases (for example argon, nitrogen, etc.) via adjustable valves 84, for adjusting the composition of the mixture formed in the chamber, and a distribution circuit which includes, in succession: a remotely controlled on/off valve 85, a pressure gauge 86 and a thermometer 87, a gas heater 88, a second combination of pressure gauge 89 and thermometer 90, a flow meter 91, a pressure regulator 92, for regulating the pressure of the gas or gas mixture in the pipes 45, and a pressure gauge 93.

A similar third circuit, for injecting inerting gas directly into the shroud, may be added to the two circuits 81 and 82.

We claim:

1. Twin-roll continuous casting device comprising two counterrotating rolls (1, 2), having parallel axes, defining between them a casting space (5), and a shroud (4) placed above the casting space and including two longitudinal walls (41) which extend respectively along the surface of each roll and which are provided with gas inlet pipes having openings emerging towards the said surfaces, characterized in that each wall (41) includes pressure-drop sealing means (50, 64) for creating a pressure drop in a zone (22) located between the said wall and the surface of the corresponding roll and between two of the said pipes (45, 46), so that the flow of gas supplied by the pipe (45) lying upstream, in relation to the direction of rotation of the roll, is directed towards the outside of the shroud and the flow of gas supplied by the pipe (46) located downstream is directed towards the casting space (5).

2. Device according to claim 1, characterized in that the said pressure-drop sealing means are formed by a projection (50) of the wall extending between the said pipes into the immediate vicinity of the surface of the roll.

3. Device according to either of claim 1, characterized in that the said pressure-drop sealing means include longitudinal grooves (64), parallel to the said pipes.

4. Device according to one of claims 1, characterized in that the said pipes (45, 46) are drilled in the said walls (41) and contain, at least in the zone of the said openings emerging opposite the surface of the roll, a porous material.

5. Device according to claim 1, characterized in that the wall (41) carries, on its outer face, a brush (51) applied against the surface of the roll.

6. Device according to claim 1, characterized in that it includes means (63, 55) for controlling the position of the shroud (4) in relation to the surface of the roll.

7. Device according claim 1, characterized in that the shroud (4) includes, on the inside, a heat shield (59) made of refractory material joining the two walls while at the same time allowing passage of a feed nozzle (7) and separating the casting space from an upper chamber of the shroud, and openings (65) are made in the said shield in order to bring the casting space into communication with the said upper chamber.

8. Device according to claim 1, characterized in that it includes adjustment means (84, 92) for independently adjusting the pressure and/or the nature of the gas supplied in each pipe (45, 46).

9. Device according to claim 1, characterized in that it includes dynamic sealing means (14) for sealing between the shroud (4) and walls (11) for the lateral containment of the casting space.

10. Device according to claim 1, characterized in that it includes dynamic sealing means for sealing between the shroud and the ends of the rolls.

* * * * *